US007266931B2

(12) United States Patent
Long, Sr.

(10) Patent No.: US 7,266,931 B2
(45) Date of Patent: Sep. 11, 2007

(54) CONCRETE SANDWICH WALL PANELS AND A CONNECTOR SYSTEM FOR USE THEREIN

(75) Inventor: Robert T. Long, Sr., Ames, IA (US)

(73) Assignee: Composite Technologies Corporation, Boohe, IA (US)

( * ) Notice: Subject to any disclaimer, the term of this patent is extended or adjusted under 35 U.S.C. 154(b) by 355 days.

(21) Appl. No.: 10/624,413

(22) Filed: Jul. 22, 2003

(65) Prior Publication Data

US 2005/0016095 A1 Jan. 27, 2005

Related U.S. Application Data

(60) Provisional application No. 60/397,550, filed on Jul. 22, 2002.

(51) Int. Cl.
*E04B 2/44* (2006.01)

(52) U.S. Cl. ..... 52/426; 52/309.11; 52/565

(58) Field of Classification Search ..... 52/309.11, 52/309.12, 309.14, 309.16, 309.17, 426, 52/410, 700, 565; 411/446, 456, 451.1, 424, 411/480, 498, 496
See application file for complete search history.

(56) References Cited

U.S. PATENT DOCUMENTS 4,393,635 A * 7/1983 Long ..... 53/309.11
4,805,366 A * 2/1989 Long ..... 52/309.11
4,829,733 A * 5/1989 Long ..... 52/309.11
5,011,354 A * 4/1991 Brownlee ..... 411/439
5,276,752 A * 1/1994 Gugelmeyer et al. ..... 385/69
5,519,973 A * 5/1996 Keith et al. ..... 52/410
5,557,898 A * 9/1996 Dixon ..... 52/410
5,606,832 A * 3/1997 Keith et al. ..... 52/410
5,671,574 A * 9/1997 Long ..... 52/309.11
5,673,525 A * 10/1997 Keith et al. ..... 52/309.11
5,996,297 A * 12/1999 Keith et al. ..... 52/410
6,018,918 A * 2/2000 Long, Sr. ..... 52/408
6,116,836 A * 9/2000 Long, Sr. ..... 411/451.1
6,223,487 B1 * 5/2001 Dinkel ..... 52/285.1
6,263,638 B1 * 7/2001 Long, Sr. ..... 52/794.1

(Continued)

FOREIGN PATENT DOCUMENTS

DE 200 08 53041 10/2000

(Continued)

OTHER PUBLICATIONS

Ganguli, U., "Wind and Air Pressures on the Building Envelope", www.nrc.ca/irc/bsi/86-2-E.html. p. 1-12, Jun. 20, 2002.

(Continued)

*Primary Examiner*—Robert Canfield
(74) *Attorney, Agent, or Firm*—Kent A. Herink; Emily E. Harris

(57) ABSTRACT

A fiber composite connector element for production of concrete cavity walls having a shaft with anchorage ends and one or more locating flanges. The anchorage ends provide bi-directional force transfer between the connector body and surrounding concrete. The connector may include a flange for orientation of the connector shaft perpendicular to a plastic concrete layer and for setting the depth of penetration of the connector into a concrete layer.

4 Claims, 6 Drawing Sheets

U.S. PATENT DOCUMENTS

| | | | | |
|---|---|---|---|---|
| 6,308,484 | B1 * | 10/2001 | Severino | 52/426 |
| 6,346,325 | B1 | 2/2002 | Edwards et al. | |
| 6,351,918 | B1 * | 3/2002 | Westra et al. | 52/404.2 |
| 6,711,862 | B1 * | 3/2004 | Long | 52/309.1 |
| 6,854,229 | B2 * | 2/2005 | Keith et al. | 52/428 |
| 2003/0115831 | A1 * | 6/2003 | Long, Sr. | 52/786.13 |

FOREIGN PATENT DOCUMENTS

| | | | |
|---|---|---|---|
| EP | 0 626 601 | A1 * | 11/1994 |
| WO | 96/30790 | * | 10/1996 |
| WO | 98/14811 | * | 4/1998 |

OTHER PUBLICATIONS

Rousseau. M.Z., "Facts and Fictions of Rain-Screen Walls", www.nrc.ca/irc/practice/wal3-E.html, p. 1-10, Jun. 20, 2002.

* cited by examiner

CONCRETE SANDWICH WALL PANELS AND A CONNECTOR SYSTEM FOR USE THEREIN

This application claims priority to U.S. patent application Ser. No. 60/397,550, filed Jul. 22, 2002.

BACKGROUND OF THE INVENTION

The invention relates generally to precast insulated concrete wall panels and, more specifically, to a precast insulated concrete wall panel having an air gap between the exterior concrete layer and the insulation layer to assist in the response of the wall to certain conditions and to a novel connector for use in fabricating the wall panels.

Precast insulated concrete wall panels are well known in the art and offer a number of advantages for residential and commercial building construction. These advantages include shorter construction schedules, improved thermal resistance, improved quality control, and enhanced durability. However, conventional concrete wall panels are heavy, thus increasing the cost of transporting the panels from the precasting plant to the job site. The large weight of the panels often times requires multiple loads to be delivered to the job site, thereby resulting in potential delays during loading, transportation, and unloading. The large weight also requires the use of an expensive, heavy crane for panel installation.

Insulated concrete wall panels with cavities are also known in the art. These wall panels include inner and outer concrete layers, or wythes, with an internal insulation layer and an air gap provided between the concrete layers, so as to be lighter weight than solid walls of the same thickness. Such hollow insulated wall panels are made by separate castings of the first and second concrete layers, with the first concrete layer being completely cured or hardened before the second concrete layer is poured. This construction method involves long delays and increased costs for the production process.

Furthermore, the prior art concrete wall panels are normally butted side to side with additional panels so as to form a wall structure. However, such a butt joint is not interlocked and thereby complicates the assembly process. In addition, the prior art concrete wall panels are constructed using metallic connectors with high thermal conductivities.

Precast concrete wall panels have recently been introduced which include inner and outer concrete layers, an internal insulation layer, and an air gap between the insulation layer and one of the concrete layers. In constructing the wall panels, the first concrete layer is poured into a form. The insulation layer is supported in a spaced relation above the first concrete layer, and the second concrete layer is poured on top of the insulation layer while the first concrete layer is still wet. Thus, the first and second concrete layers cure substantially simultaneously. A plurality of connectors or rods extend through the foam with opposite ends embedded in the first and second concrete layers. An enlarged flange on each connector supports the insulation layer above the first concrete layer to provide an air gap therebetween.

After the concrete layers have hardened, the wall panels can be lifted and installed in a vertical orientation on footings or another base. The edges of the panels may be contoured, so as to matingly engage with a corresponding edge on an adjacent panel, thereby providing an interlocking joint between adjacent panels. The panels can be assembled adjacent one another and on top of one another so as to provide a form which becomes an integral part of the wall structure. The assembled panels create a continuous form, with the air gap in the panels being filled with concrete. Prior to filling the air gap, the joints between panels may be filled with a sealant or foam, thereby reducing the potential for leakage during filling of the air gap with on-site concrete.

The upper edges of the inner concrete layer may include a notch to receive a floor or roof joist. The joists are thus supported by the inner concrete layer of the wall panels without the need for a ledger beam attached to the inside face of the wall panels. The thickness of the insulation layer can be determined based upon thermal insulation requirements as well as upon mechanical requirements for the insulation material acting as a concrete form. Where required for mechanical purposes, enhanced insulation material may be used incorporating fiber reinforcement, surface laminations, increased density or combinations thereof.

Accordingly, a primary objective of the present invention is the provision of an improved method of forming concrete wall panels.

Another objective of the present invention is the provision of an improved hollow concrete wall panel.

A further objective of the present invention is the provision of a lightweight insulated wall panel useful in forming an integral concrete wall structure.

Yet another object of the present invention is the provision of an insulated wall panel that has an air gap between the outside wythe and the insulation that remains following use of the wall panel in the construction of a concrete wall structure.

A further objective of the present invention is the provision of a hollow concrete wall panel wherein the connectors also provide support for reinforcing grids used for reinforcing the concrete wythes.

Another objective of the present invention is the provision of a quick and easy method of precasting concrete wall panels.

A still further objective of the present invention is the provision of an improved concrete wall panel with a high degree of thermal insulation.

A further objective of the present invention is an improved concrete wall panel which is economical to manufacture and durable and safe in use.

These and other objectives become apparent from the following description of the invention.

SUMMARY OF THE INVENTION

The precast wall panels of the present invention include inner and outer concrete layers, an internal insulation layer, and an air gap between the insulation layer and one of the concrete layers. In constructing the wall panels, the first concrete layer is poured into a form. The insulation layer is supported in a spaced relation above the first concrete layer, and the second concrete layer is poured on top of the insulation layer while the first concrete layer is still wet. Thus, the first and second concrete layers cure substantially simultaneously. A plurality of connectors or rods extends through the foam with opposite ends embedded in the first and second concrete layers. An enlarged flange on each connector supports the insulation layer above the first concrete layer to provide an air gap therebetween.

A unique connector is used in the fabrication of the precast wall panels. The connector has at least one of its end portions terminated in a vertex or point so as to reduce the surface area of the connector that may be visible in the outer surface of the concrete wall after casting. The connector may include support members located at selected distances on the end portions of the connectors and which snap onto the reinforcing grid used to reinforce the concrete wythes. In this embodiment, the connectors thus support the reinforcing grid at a preferred location.

In a preferred embodiment, the system of connector/spacer elements, insulation and reinforcing grids may be assembled into a unit and lowered onto an initial, fresh (unhardened) concrete layer that has been poured in a form. The plurality of connector elements extend from the forming surface for the first concrete layer and have flanges that support the insulation layer and the weight of the second layer. The connectors therefore space apart the two concrete layers. In a second embodiment, a plurality of connectors is pushed into a first concrete layer so that anchorage ends are embedded in the first concrete layer. After the first concrete layer has hardened, the concrete and connector assembly is rotated so that the free ends of the connector elements can be lowered into a fresh, second layer of concrete. The ends of the connector elements may touch the forming surface for the second concrete layer and thereby act to space apart the two concrete layers. In this embodiment, the connectors may be installed through an insulation layer that has been placed on the first concrete layer. Alternatively, the connectors may be configured with a flange that keeps the connector normal to the surface of the first concrete layer.

DETAILED DESCRIPTION OF THE PREFERRED EMBODIMENTS

The construction of the precast insulated concrete wall panels of the present invention follows substantially the identical procedure set out in U.S. Pat. No. 6,263,638, which is incorporated herein by this reference. The wall panels of the present invention are intended for use as components of a concrete wall system of a building, similar to the wall panels of the '638 patent, but without the use of poured concrete to fill up the air gap between the outside wythe and the insulation. Rather, this air gap is left empty and provides advantages as will be described below.

Figure 1:
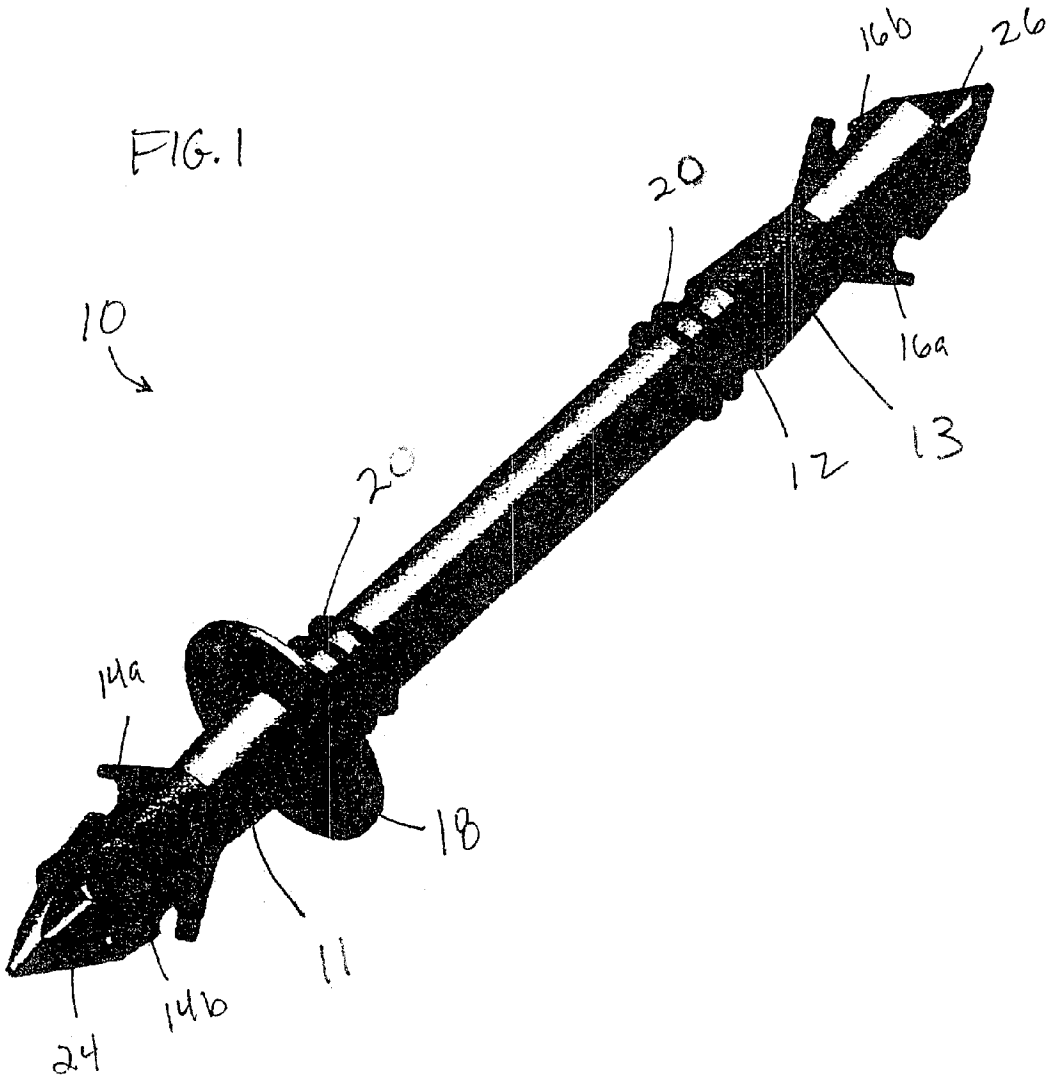
FIG. 1 is a perspective view showing a connector according to the present invention, including two pair of ears which snap onto and support the reinforcing grids.

Illustrated in FIG. 1, generally at 10, is a novel connector for use in forming the precast concrete wall panels of the present invention. The connector 10 has a central longitudinal component (a portion of which is illustrated in FIG. 1 at 12) that is fabricated from fiber-reinforced composite to which has been over-molded one or more components using a polymer, preferably one compatible with the matrix of the composite. In the connector 10 of the preferred embodiment, two over-molded components 11 and 13 (FIGS. 1 and 3) have been used, one on either side of the exposed portion of the composite component 12. The composite component 12 is initially formed by pultrusion and has a profile that is constant over its length. To assist in retaining the over-molded components 11 and 13 on the composite component 12, one or more of the end portions of the composite component 12 may be radially expanded. One method of accomplishing such radial expansion is by the longitudinal insertion of a heated spike into the end of the composite component 12. The heated spike will force the end portion of the composite component 12 to flare radially outwardly, increasing the radial dimension of the end portion progressively toward the terminus of the composite component 12. When the over-molded portions 11 and 13 are molded onto the composite component 12, the flared end portions will assist in preventing the over-molded components 11 and 13 from being pulled off of the composite component 12 when the connector 10 is in use with over-molded components 11 and 13 embedded in separate concrete wythes and a tension is present in the connector 10. Of course, other methods may be used to radially expand the end portions of the composite connector, such as by the use of an oven or microwave energy to heat the end portion to or near to the melt temperature of the composite matrix whereupon the stored energy of the composite will act to expand the radial dimension of the composite 10.

Figure 2:
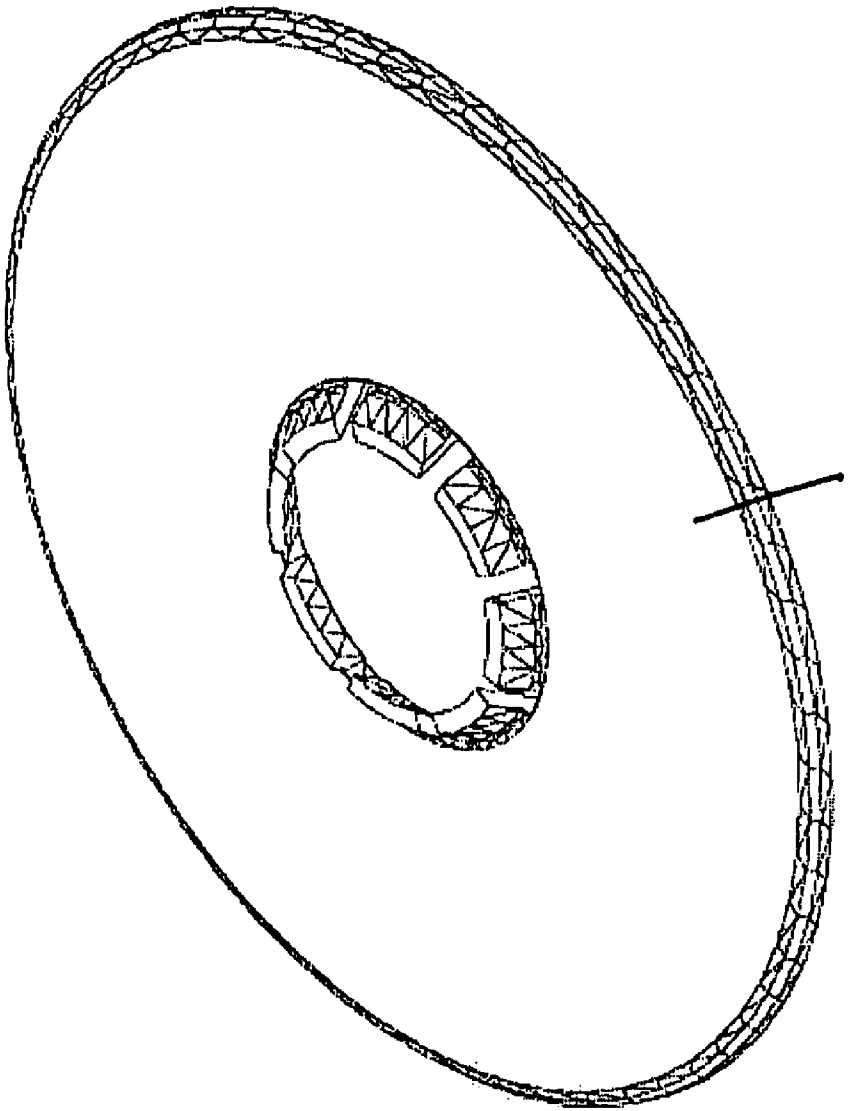
FIG. 2 is a perspective view of a retaining ring that is received on the connector and is used to support the insulation.

The over-molded components 11 and 13 of the connector 10 provide two pairs of retaining ears, or locating flanges, 14*a-b* and 16*a-b*, that are used for retaining in a snap fit a reinforcing grid that is used in the conventional manner to reinforce the concrete wythes. The ears 14 and 16 are spaced from the ends of the connector the appropriate distance so as to support the reinforcing grid at the desired position in the concrete wythe. Additionally, one of the over-molded components 11 provides a washer 18 which is used to support a layer of insulation during the fabrication of a precast wall panel using the connectors 10. A plurality of ridges 20 are formed in the over-molded component 11 and will serve to support a separate washer 22 (FIG. 2) which may be received about the connector 10 and is attached thereto by a snap-fit with any selected one of the plurality of ridges 20. Finally, a conical end 24, 26 is formed into each of the over-molded components 11 and 13. The vertex of the conical ends 24, 26 will support the connectors 10 when casting a wall panel using the connectors 10 and, being of only a small dimension, will reduce the visibility of the connectors 10 exteriorly of the wall panel once formed.

Figure 3:
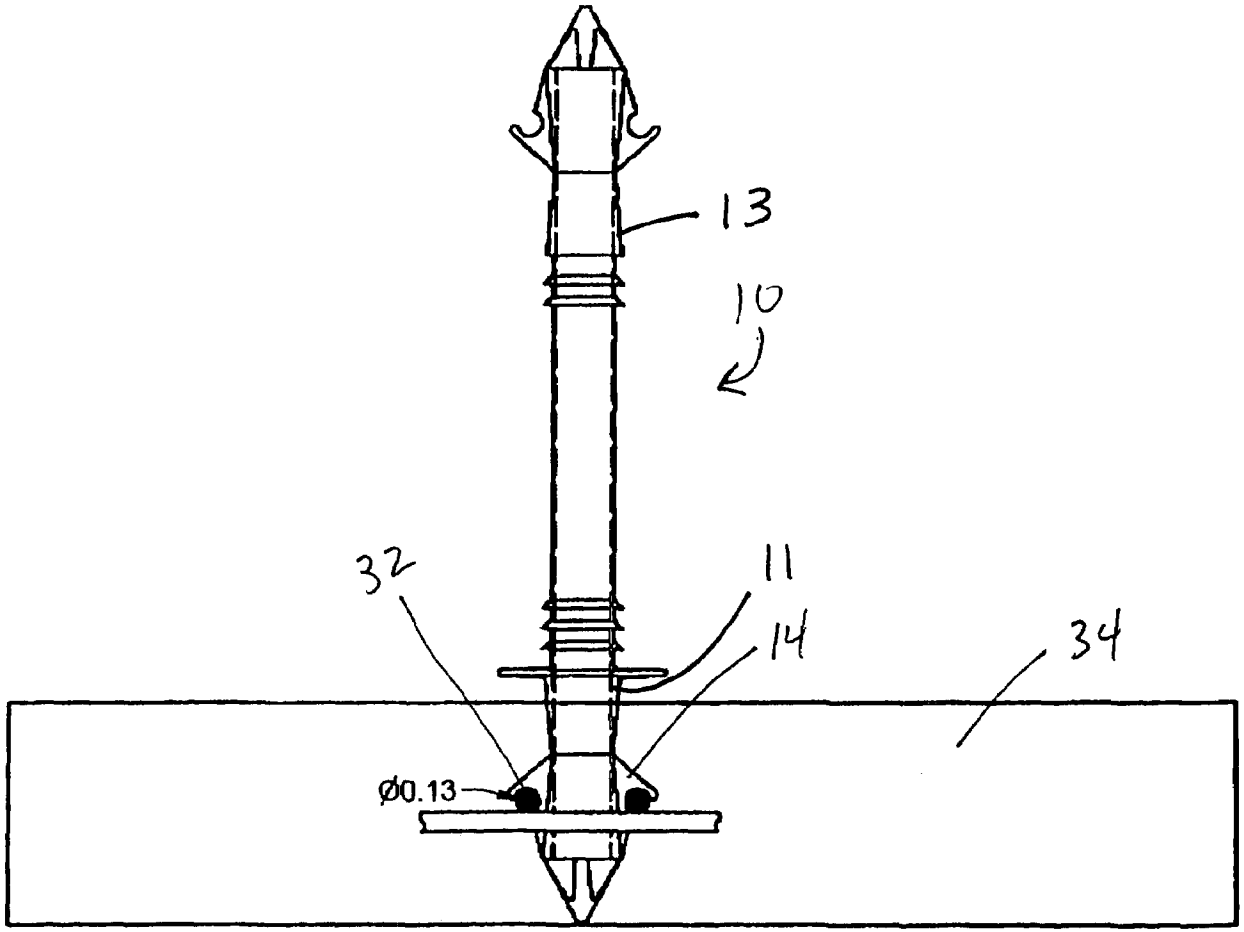
FIG. 3 is a sectional view of a connector of FIG. 1, wherein a reinforcing grid has been snapped into a pair of ears extended from the connector and both of which are embedded in a concrete wythe.

FIG. 3 illustrates a connector 10 supporting in a pair of ears 14*a-b* a welded wire reinforcing grid 32 centrally of a concrete layer 34.

Figure 4:
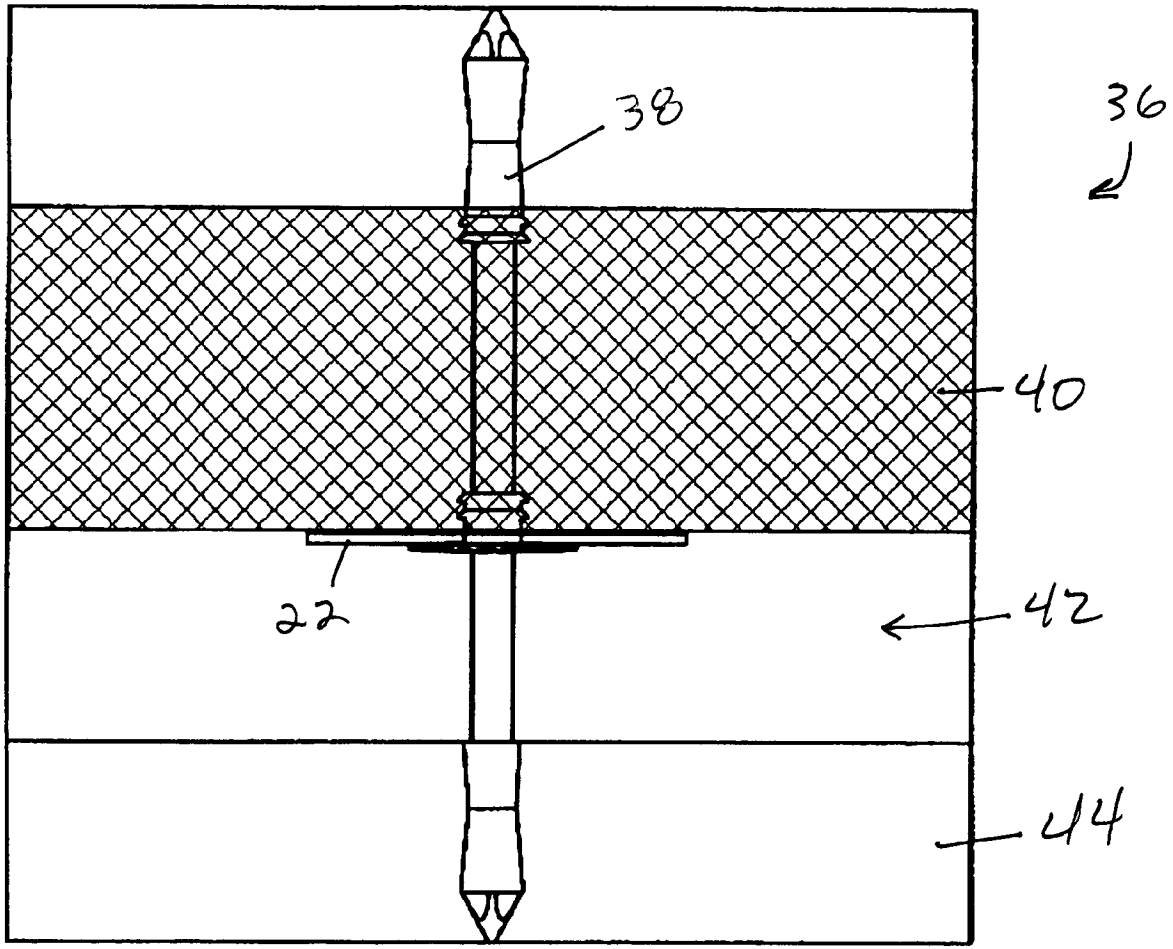
FIG. 4 is a sectional view of a connector of the present invention embedded in a pair of spaced apart concrete wythes and a washer supporting a layer of insulation.

FIG. 4 illustrates a section of a concrete panel 36 formed using a connector 38 wherein a separate washer 22 has been used to provide additional support to the insulation 40. Note that an air gap 42 has been created between the insulation 40 and the exterior wythe 44.

Figure 5:
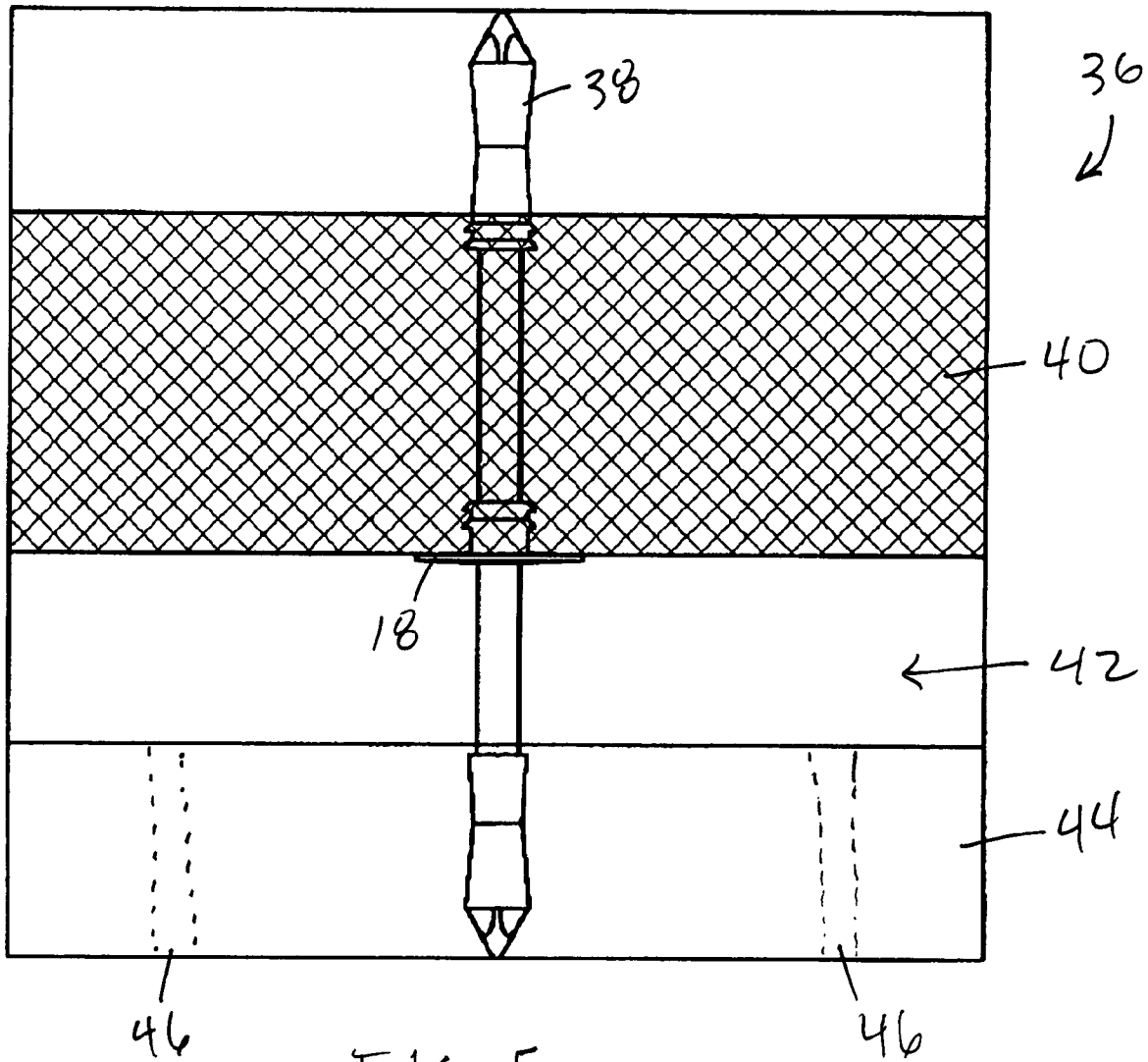
FIG. 5 is a view similar to FIG. 4, showing an alternative washer and a vent allowing air to communicate between the exterior of the outer wythe and the air gap between the outer wythe and the insulation.

As illustrated in FIG. 5, the connector 38 can also be used turned end-for-end.

Figure 6:
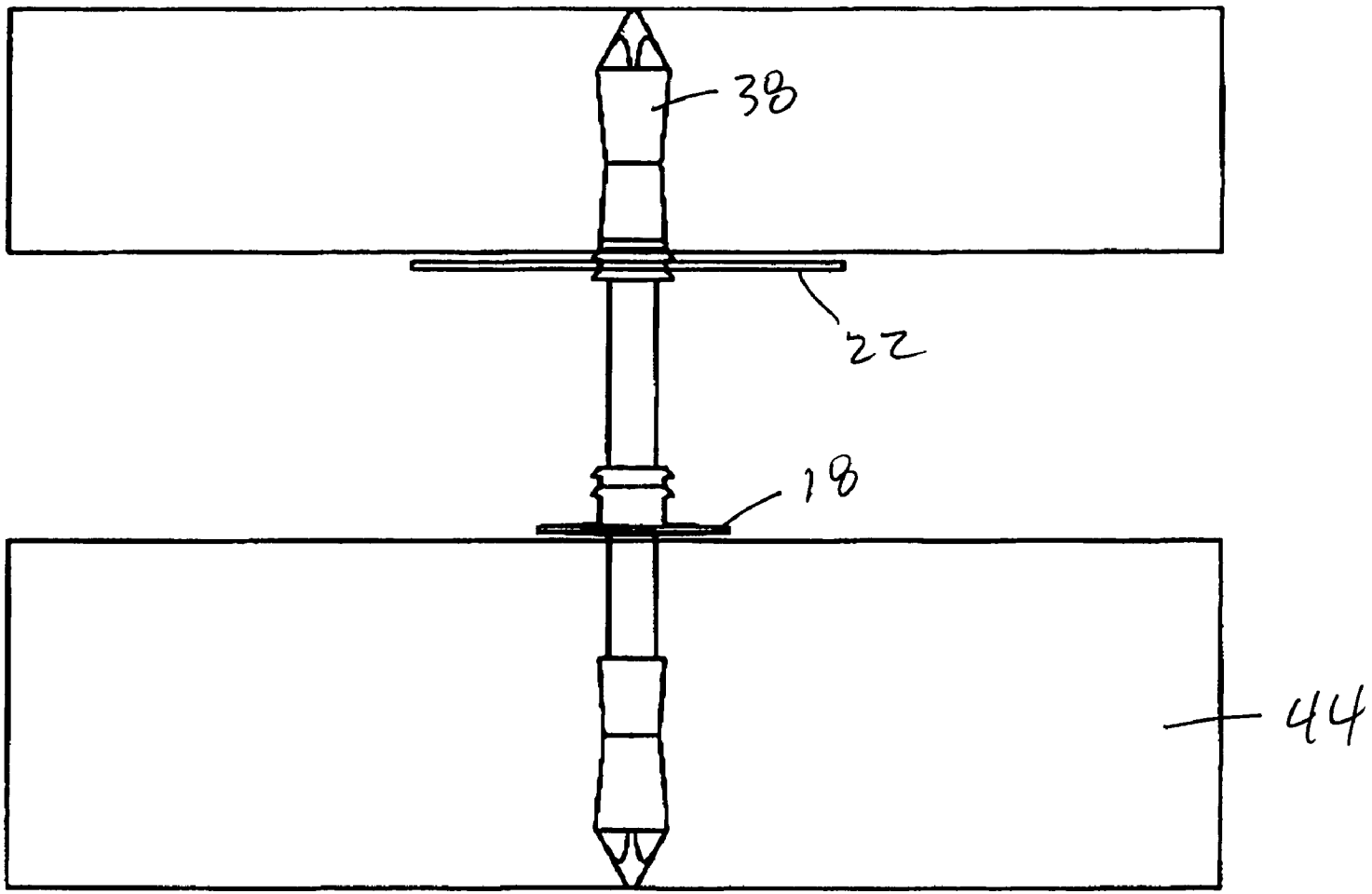
FIG. 6 is a sectional view of a connector of the present invention embedded in a pair of spaced apart concrete wythes and a washer that served to stabilize the connector after it was placed in the first concrete layer (now shown as the upper layer).

As illustrated in FIG. 6, the connector 38 can be placed in concrete without insulation. In this case washer 22 may be added to provide stability so that the connector will remain normal to the concrete layer during installation.

A plurality of vents 46 may be formed in the exterior wythe 44 to permit air communication between the exterior of the wythe 44 and the air gap 42. This will provide the advantages as are discussed in the prior art, including publications of the National Research Council of Canada entitled *Wind and Air Pressures on the Building Envelope* by U. Ganguli and Facts *and Fictions of Rain-Screen Walls* by M. Z. Rousseau. Specifically, the vents 46 allow for air pressure on the exterior of a building constructed using the wall panels of the present invention to equalize with the air gap. Accordingly, if there is a suction or reduced pressure exteriorly of the wall panel, the air pressure in the air gap will be reduced through the vents 46, thus relieving any tension that would otherwise be created in the connectors. Another advantage is the relief of a positive air pressure differential which will prevent wind-driven rain from being drawn to the inside of the exterior wythe. The air gap also forms a plenum between the exterior wythe and the insulation which under certain circumstances can permit the convection of air through the air gap to reduce the temperature between the air gap and the air outside the exterior wythe. The air gap may also provide a degree of blast protection to the wall panel. A blast from an explosion exteriorly of the wall panel will create a shock wave that will impinge on the exterior wythe and act to force it towards the interior. The blast or shock wave creates, in a very short period of time, a large over-pressure on the outer surface of the exterior wythe. As the exterior wythe moves toward the interior, the air gap will be compressed and absorb some of the energy of the exterior wythe, cushioning the blast effect on the insulation and other wall panel components.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

I claim:

1. A connector element for production of concrete cavity walls, comprising:

a) a fiber composite shaft with at least one over-molded component at one end of the of the fiber composite shaft comprising at least one end embedded in the concrete and one or more locating flanges wherein the end provides bi-directional force transfer between the connector body and surrounding concrete;

b) a washer for orientation of the connector shaft perpendicular to a plastic concrete layer; and c) snap features for connecting to reinforcing steel.

2. The connector element of claim 1 with a washer for setting the depth of penetration of the connector into a concrete layer.

3. The connector element of claim 1 with a pointed end to set the distance from a form surface to the end of the connector.

4. The connector element of claim 1 wherein the over-molded component is made from a polymer.

* * * * *